United States Patent [19]

Sjotun et al.

[11] 4,248,153

[45] Feb. 3, 1981

[54] COMBINATION FUZE FOR MISSILES

[75] Inventors: Kyrre Sjøtun; Tore Rognmo, both of Kongsberg, Norway

[73] Assignee: A/S Kongsberg Våpenfabrikk, Norway

[21] Appl. No.: 966,860

[22] Filed: Dec. 6, 1978

[30] Foreign Application Priority Data

Dec. 21, 1977 [NO] Norway ..... 774405

[51] Int. Cl.[3] ..... F42C 11/00

[52] U.S. Cl. ..... 102/208; 102/207; 102/211; 102/270

[58] Field of Search ..... 102/200, 206, 207, 208, 102/211, 265, 270

[56] References Cited

U.S. PATENT DOCUMENTS

| | | | |
|---|---|---|---|
| 3,377,954 | 4/1968 | Rabinow | 102/208 |
| 3,435,767 | 4/1969 | Stav | 102/208 |
| 3,877,378 | 4/1975 | Clark | 102/211 |

FOREIGN PATENT DOCUMENTS

| | | | |
|---|---|---|---|
| 2011042 | 7/1979 | United Kingdom | 102/211 |

*Primary Examiner*—Donald P. Walsh
*Attorney, Agent, or Firm*—Holman & Stern

[57] ABSTRACT

In a combination fuze for missiles comprising a current generator which is driven by a ram air operated means having ram air supplied through an inlet in the nose portion of the missile and supplying electric energy to an electric firing circuit which comprises an electric detonator and means adapted to detonate the electric detonator before the missile reaches the target, and comprising a mechanical percussion switch adapted to cause detonation of the missile upon impingement of the missile against the target, the mechanical percussion switch comprises a sting sensitive detonator surrounded by a metal foil and a firing needle which is included in the electric firing circuit. Upon impact the relative movement between the firing needle and the sting sensitive detonator induces such a circuit configuration of the firing circuit that triggering of the electric detonator will take place. By using a jacket which partly or completely blocks the electric firing circuit the combination fuze may be operated with three various functions, i.e. as a proximity fuze with a first electric percussion function and a second mechanical percussion function as further securities for firing, as a percussion fuze having electric firing of the electric detonator with a mechanical percussion function as a further security for firing, as well as a percussion fuze with mechanical firing only.

6 Claims, 3 Drawing Figures

COMBINATION FUZE FOR MISSILES

BRIEF SUMMARY OF THE INVENTION

The present invention relates to a combination fuze for missiles for launching towards a target, comprising a current generator which is driven by a ram air operated means which has ram air supplied thereto through an inlet in the nose portion of the missile, and which supplies electric energy to an electric firing circuit comprising an electric detonator and means which are adapted to via the electric detonator to detonate the missile before this comes in physical contact with the target, and comprising a mechanical percussion switch which is adapted to cause detonation of the missile upon impact of the missile against the target.

STATEMENT OF PRIOR ART

From U.S. Pat. No. 3,877,378 there is known a fuze which by means of a detachable jacket may function either as a proximity fuze or a percussion fuze. However, the known fuze can only imply the proximity principle in fair weather, because inclement weather, such as rain, snow or heavy clouds, prohibits the use of the proximity function. It is necessary in bad weather, therefore, to render the proximity element inoperative.

The object of the present invention is to give instructions for a combination fuze which makes the selection of not only two functions possible, but three functions, said three functions being independent of the weather conditions at the time of launching the missile.

According to the present invention, this is achieved in that the mechanical percussion switch comprises a sting sensitive detonator possibly including a pyrotechnical delay and being equipped with a metal foil, and a firing needle which is included in the electric firing circuit, that the relative movement taking place between the firing needle and the sting sensitive detonator upon impact induces such a circuit configuration of the firing circuit that triggering of the electric detonator takes place, and that the fuze as known per se comprises an easily detachable nose jacket, which jacket is so adapted that when attached to the nose portion of the missile it completely or partly inactivates the electric firing circuit, so that the fuze when having attached thereto a jacket which prevents the supply of ram air to the ram air operated means, functions as a percussion fuze with mechanical firing of the sting sensitive detonator, and so that the fuze when having attached thereto a jacket which permits ram air to drive the ram air operated means for the supply of electric energy to the electric firing circuit, but which disconnects the proximity functions of the fuze, functions as a percussion fuze with electric firing of the electric detonator, and so that the fuze when having no jacket functions as a proximity fuze having a first electric percussion function and a second mechanical percussion function as further security for firing.

Thus, by giving the nose jacket a suitable configuration and by having it on or removed from the nose portion of the missile, several different functions for the missile can be obtained.

Usually, the missiles will be stored and transported to the launching location having the jacket attached to the nose portion of the missile. Dependent on whether the nose jacket is removed or not a selection between the following functions can be made;

(a) firing of the explosive charge of the missile during the flight thereof towards the target including alternative electric ground function or additional mechanical ground function;

(b) electric ground function including additional mechanical ground function;

(c) only mechanical ground function with possible time delay.

Under item (a) the missile is launched without a nose jacket and will normally function as a proximity fuze. Sorted under item (b) are the cases where the missile is launched with the nose jacket put on, but where the nose jacket has for its purpose to inactivate the electric components inducing firing in the trajectory without disconnecting the remaining electric functions.

Under alternative (c) where only the mechanical ground function comes into effect, the missile is launched with the nose jacket put on, the jacket then blocking every electric function in the missile, for example by blocking the ram air inlet in the nose portion of the missile, provided a missile having a current generator driven by a ram air operated turbine is used.

For the identification of the missile or the various functions even in darkness, the jacket may be provided with outer ribs or other protrusions which may easily be identified by the launching crew. Besides, the jacket may be provided with inwardly protruding knobs fitting into inner sloped tracks in the nose portion of the missile, and serving for locking of the jacket by suitable twisting thereof. Such a manner of fixing entails that the jacket is kept in position during launching, but can be easily removed prior to the launching if so desired.

The invention will be further described, reference being had to the drawing which illustrates an embodiment of the present invention.

DETAILED DESCRIPTION

Figure 1:
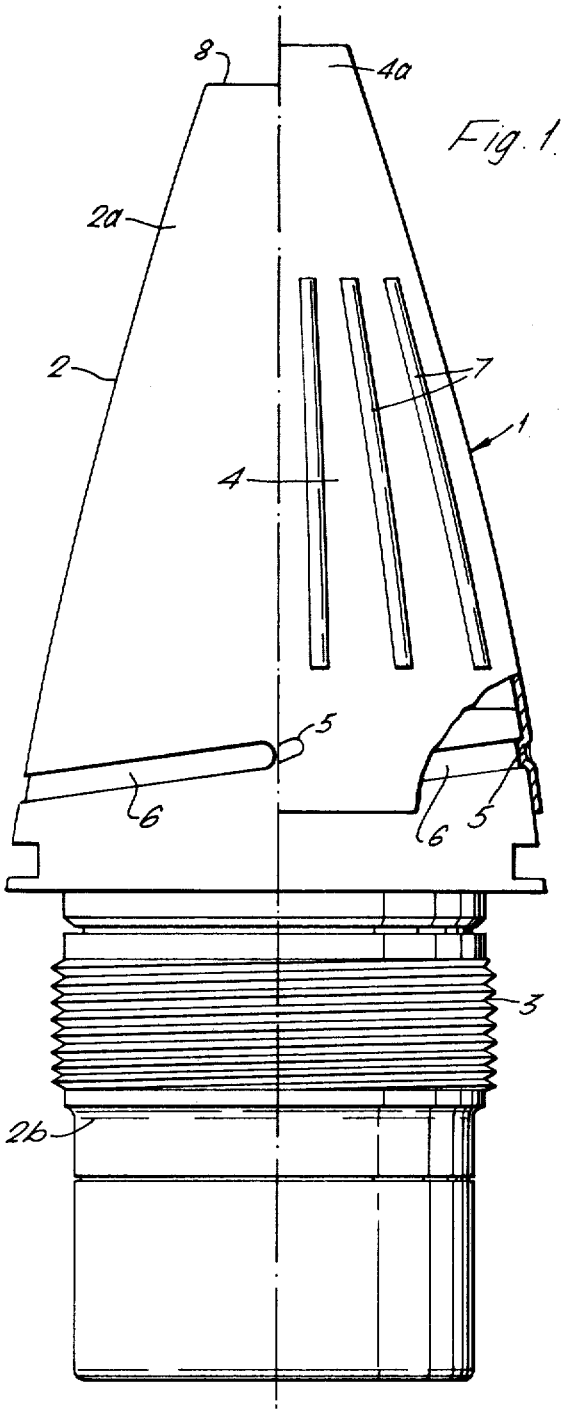
FIG. 1 is a side view, partly in section, of a nose portion of a missile having mounted thereon a nose jacket serving to alter the firing function of the missile.

In FIG. 1 there is illustrated the front portion of a missile 1, more particularly a nose portion 2 which aside from consisting of a conical front portion 2*a*, also includes a cylindrical rear portion 2*b* provided with threads 3 serving to attach the nose portion 2 to the remaining (not illustrated) parts which constitute the finished mounted missile.

Figure 2:
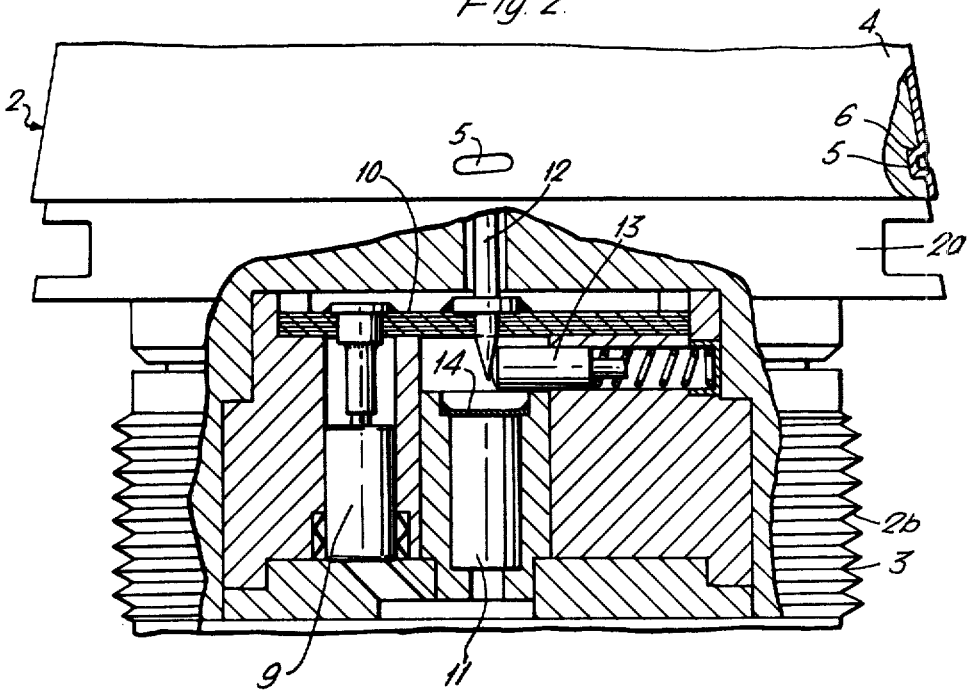
FIG. 2 is on a larger scale a fragmentary view, partly in section, of the nose portion of the missile and illustrates the major components included in a combination fuze according to the invention.

On the conical portion 2*a* of the nose portion 2 there is attached a cap or jacket 4 which in FIG. 1 and FIG. 2 is partly cut away for reasons of survey. The jacket may have a shape which largely corresponds to the conical portion 2*a* so as to facilitate the attachment thereto. Close to the lower edge the jacket 4 is provided with inwardly protruding knobs 5 which when the jacket 4 is put on, fit into sloped tracks 6 made in the nose portion 2. When putting the jacket 4 on, the knobs 5 will slip into either track 6 and will upon twisting of the jacket 4 in correct direction attach the jacket firmly to the nose portion 2. The jacket 4 is also provided with outer ribs 7, so that even in darkness it is possible in an easy and safe manner to determine whether a jacket is on the nose portion of the missile. Besides, the ribs 7 serve to facilitate the attachment or the removal of the jacket to or from the nose portion of the missile.

The front or most narrow portion 4a of the jacket 4 embraces the front edge 8 of the nose portion 2 completely or partly dependent on the components which are built into the nose portion and which will be described in detail in the following.

In FIG. 2 which is a fragmentary view, partly in section, of the nose portion 2, there is seen as previously the conical front portion 2a, cylindrical rear portion 2b having threads 3, as well as the nose jacket 4 attached to the portion 2a and having fixing knobs 5 fitting into a track 6 in the nose portion of the missile.

Figure 3:
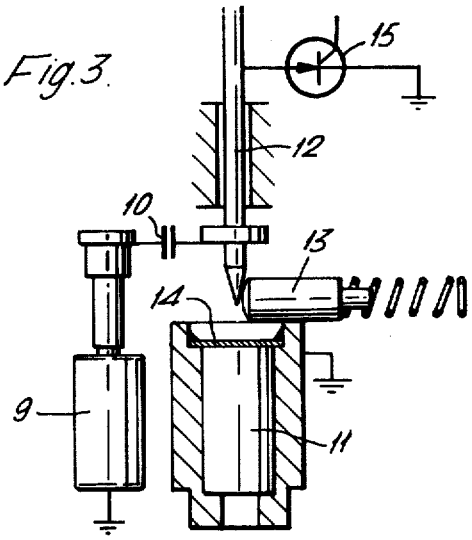
FIG. 3 is a diagrammatic sketch of principle of the most important components of the fuze, and illustrates the various functions thereof.

Further, in FIG. 2 and in FIG. 3, 9 designates an electric detonator, 10 a firing capacitor, 11 a sting sensitive detonator with or without a delay, 12 a flashing or firing needle, 13 a centrifugal lock, 14 a metal foil and 15 an electronic valve, for example a thyristor. The plate which surrounds and is attached to the firing needle, is a printed circuit plate (isolating material) having the firing capacitor soldered thereon.

The electric detonator 9 and the thyristor 15 as well as the firing capacitor 10, are included in an electric circuit which is controlled by predetermined functions, for example a timer function or a proximity function or other functions contingent on conditions associated with the flight of the missile. If the electric circuit is controlled by a proximity function the circuit may be designed as disclosed in U.S. Pat. No. 3,802,343. From this patent specification it is also known that fuzes of the type proximity fuzes usually are provided with an extra percussion switch which comes into operation upon impact and takes over the role of the thyristor if the proximity function should fail or be absent. Such an extra percussion switch is not illustrated in the present Figures, the use and connection of such a switch being well known in this field of the art.

Thus, there is previously known a combination fuze having two functions, the gist of the first being an adjustable detonation of the missile when this is in the trajectory or close to the intended target, and the gist of the other being a firing associated with the first function and being effective if the first-mentioned function should fail.

When additionally using a sting sensitive detonator, i.e. a mechanically influenced detonator in combination with a nose jacket, there is achieved a combination fuze which easily increases the possible applicabilities of the fuze. By means of the jacket the choice of for example proximity or ground function can be made immediately prior to the launching, the presence of the jacket on the nose portion of the missile or completely or partly removal of the jacket giving different firing functions depending on the remaining structure of the missile.

In the illustrated embodiment the missile is contemplated being equipped with a ram air turbine driving a generator. Subsequent to the launching of the missile ram air will be forced in through a passageway extending from an opening in the nose portion of the missile, for example at 8, as illustrated in FIG. 1, and to the turbine which is mounted in the nose portion. A preferred embodiment of a ram air generator and turbine is disclosed in U.S. Pat. No. 3,826,193, and it is to be understood that the generator delivers current to the above-mentioned controlled electric circuit during the flight of the missile.

Thus, the firing capacitor 10 will be discharged only subsequent to the lapse of a certain time after the launching of the missile, and dependent on the function to which the electric circuit shall respond to it will on a suitable point in the trajectory be discharged through the electric detonator 9, which in turn will fire the explosive charge of the missile.

If the nose jacket 4 is designed as a cap or a goblet, i.e. with a closed top, and the missile is launched with such a jacket 4 covering the supply of ram air to the generator, all of the electric functions will be inactivated. This means that in this case the firing capacitor 10 will not be charged, and neither will the proximity or other electronically conditioned functions come into effect. Neither will the extra percussion switch have any effect in this case, since the charging of the firing capacitor 10 will be absent.

However, in the described embodiment, although the electric functions are blocked or remain absent, the missile is able to operate as a pure percussion missile. This is due to the sting sensitive detonator 11, which prior to impact is kept in place by a spring (not illustrated) and which will impinge against the firing needle 12 when the missile hits the target, the centrifugal lock 13 being thrown out and releasing the detonator 11 already right after the launching of the missile.

If the missile is launched without the nose jacket 4, i.e. as a missile having a proximity function, the sting sensitive detonator 11 will render a further firing security in addition to the previously discussed percussion contact. However, if the proximity function fails it is desired that the detonation takes place as early as possible upon the occurence of impact, and as a consequence of a least possible interaction. This is different from a normal percussion function which often gives detonation a certain time after the impact, so as to allow the missile to be forced into the target or the ground. Such a time delay can for example be built into the sting sensitive detonator 11, but an inherent time delay also makes itself evident because the detonator, in order to be fired, needs a certain amount of kinetic energy when hitting the firing needle, an energy which is developed due to the braking of the missile when penetrating into the ground.

To achieve the quickest possible firing upon the occurence of impact the thin metal foil 14 covering the side of the sting sensitive detonator 11 facing towards the firing needle 12, is grounded. Further, the side of the firing capacitor 10 facing away from the electric detonator 9, is connected to the thyristor 15 via the firing needle 12, so that a contact between the tip of the firing needle 12 and the metal foil 14 will result in a connection of the firing capacitor 12 to ground. If the capacitor is charged, this will entail a discharge thereof through the electric detonator 9. Thus, by failure of the electric proximity or timer function one will have not only two additional securities for detonation of the missile upon impact, but also achieve a discharge of the firing capacitor with a minimum time delay.

If the electric current supply should fail, the mechanical sting sensitive detonator 11 will provide for detonation in a mechanical way, even if the detonation should occur a certain time subsequent to the impact.

Aside from functioning as a blocking of the trajectory functions of the missile when covering the ram air opening, the jacket can also, in the cases where other current sources than a ram air generator are considered, be equipped with means which short-circuit the antenna system for the trajectory functions. By such an antenna signal blocking jacket the electronic circuits as for the rest may be operational, so as to achieve a ground missile having a primary electric detonation and a secondary mechanical detonation.

If such a jacket is to be used in connection with a ram air generator, the jacket must, aside from being equipped with means for selective disconnection of certain elements in the electric circuit, be provided with an open area in the region of the inlet opening of the ram air passageway.

It is to be understood that the present invention may be implemented in many different manners. By combining various types of jackets and electric systems in the missile there may by simple means be achieved the following functions;

(a) detonation of the missile in the trajectory with additional alternative electric ground function, (b) electric ground function with the addition of mechanical ground function, (c) only mechanical ground function with inherent possible further time delay.

The adjustable functions of the fuze can be chosen prior to the launching either by keeping a jacket which has a special shape, on the nose portion of the fuze, or removing the jacket therefrom before the launching of the missile. Aside from giving the fuze a special function the jacket also serves as a protection during storage and is easily detachable without a special tool. It can also be provided with outer ribs so that even in darkness it is possible in an easy and safe manner to determine whether the jacket is on or off. Possibly, the jacket may have various colours to facilitate the identification of the functional operations.

We claim

1. A combination fuze for missiles for launching towards a target, comprising a current generator which is driven by a ram air operated means which has ram air supplied thereto through an inlet in the nose portion of the missile and which supplies electric energy to an electric firing circuit comprising an electric detonator and means which are adapted via the electric detonator to detonate the missile before it comes in physical contact with the target, and a mechanical percussion switch which is adapted to cause detonation of the missile upon impact of the missile on the target, wherein the mechanicl percussion switch comprises a sting sensitive detonator including a pyrotechnical delay and being equipped with a metal foil, and a firing needle which is included in the electric firing circuit, these parts being adapted for relative movement between the firing needle and the sting sensitive detonator upon impact which induces a circuit configuration of the firing circuit that triggers the electric detonator, an easily detachable nose jacket so adapted that when attached to the nose portion of the missile it completely or partly inactivates the electric firing circuit, so that the fuze when having attached thereto a jacket which prevents the supply of ram air to the ram air operated means, functions as a percussion fuze with mechanical firing of the sting sensitive detonator, and so that the fuze when having attached thereto a jacket which permits ram air to drive the ram air operated means for the supply of electric energy to the electric firing circuit, but which disconnects the proximity functions of the fuze, functions as a percussion fuze with electric firing of the electric detonator, and so that the fuze when having no jacket functions as a proximity fuze having a first electric percussion function and a second mechanical percussion function as further security for firing.

2. A fuze as claimed in claim 1, wherein the sting sensitive detonator equipped with said metal foil is included in an electric firing circuit comprising a capacitor which is charged by said ram air operated current generator, said capacitor being discharged through the electric detonator for detonation thereof, either via an electric valve controlled by a proximity function or similar, or via the sting sensitive detonator and the firing needle thereof, the movement of the sting sensitive detonator which takes place upon impact of the missile causes contact between the firing needle in the electric circuit and said metal foil on the sting sensitive detonator for establishing a discharge path for the capacitor through the electric detonator.

3. A fuze as claimed in claim 1 or 2, wherein the nose jacket has an open front portion which, when the jacket is attached to the fuze, permits the intrusion of ram air for operating said generator, and the jacket is equipped with a means which, when the jacket is attached to the fuze, influences a means serving to disconnect the components making the proximity function operational, but without preventing the charging of the firing capacitor, so that upon impact the firing capacitor is discharged via the firing needle and said metal foil for firing the electric detonator.

4. A fuze as claimed in claim 3 wherein the nose jacket is a whole, cup-shaped jacket, and the jacket when in attached position on the fuze blocks the supply of ram air and thereby the electric functions.

5. A fuze as claimed in claim 1 or 2 wherein the jacket is equipped with outer ribs or protrusions and/or colour which may easily identify a desired functional property for the fuze.

6. A fuze as claimed in claim 1 or 2 wherein the jacket is provided with inwardly protruding knobs which fit into outer sloped tracks in the nose portion of the missile, and which upon suitable twisting of the jacket, slide in the tracks and lock the jacket to the nose portion.

* * * * *